US005749136A

United States Patent [19]

Bodiford

[11] Patent Number: 5,749,136

[45] Date of Patent: May 12, 1998

[54] INSULATING SLEEVE REMOVING DEVICE

[76] Inventor: Glen Bodiford, 6641 Viking Way, Theodore, Ala. 36582

[21] Appl. No.: 730,132

[22] Filed: Oct. 15, 1996

[51] Int. Cl.[6] ..... B23P 19/02

[52] U.S. Cl. ..... 29/426.5; 29/235; 29/467; 29/468

[58] Field of Search ..... 273/336, 337; 29/235, 234, 239, 255, 263, 275, 282, 283, 270, 278, 426.5, 467, 468; 269/47

[56] References Cited

U.S. PATENT DOCUMENTS

| | | | |
|---|---|---|---|
| 1,899,820 | 2/1933 | Milne | 273/336 |
| 2,265,517 | 12/1941 | Clement | 273/336 |
| 2,506,932 | 5/1950 | McAfee | 273/336 |
| 4,203,592 | 5/1980 | Quatkemeyer | 273/336 |
| 4,564,989 | 1/1986 | Sogandares | 29/235 |
| 5,079,978 | 1/1992 | Kupfer | 81/DIG. 5 |

*Primary Examiner*—Robert C. Watson

[57] ABSTRACT

An insulating sleeve removing device including a base member having a planar upper surface and a planar lower surface. A side wall of the base member has indicia thereon. A shaft member having a cylindrical configuration is secured to a central portion of the planar upper surface of the base member in an orthogonal relationship. An upper end of the shaft member is receivable within a venting aperture of an insulating sleeve for dislodging a can from within the insulating sleeve when the can is positioned therein.

2 Claims, 2 Drawing Sheets

FIG 3
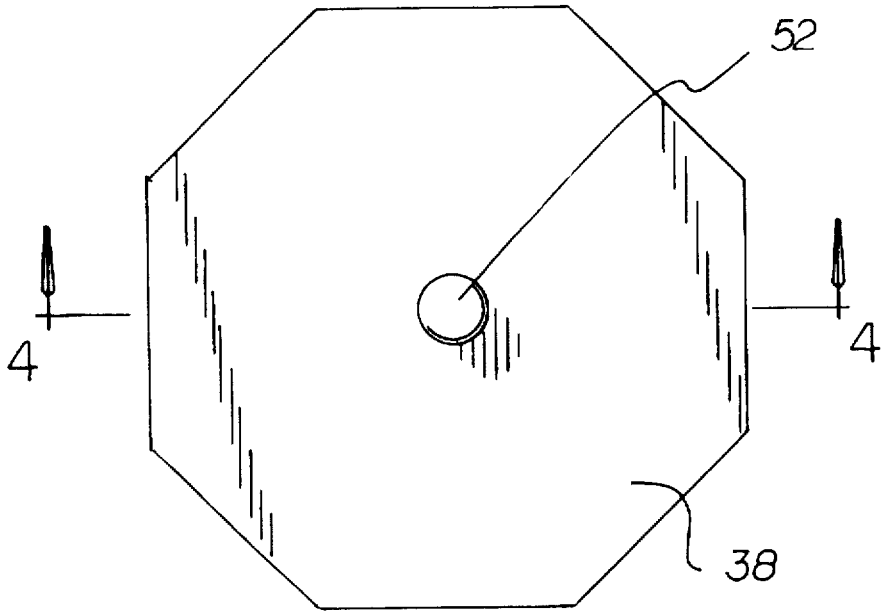
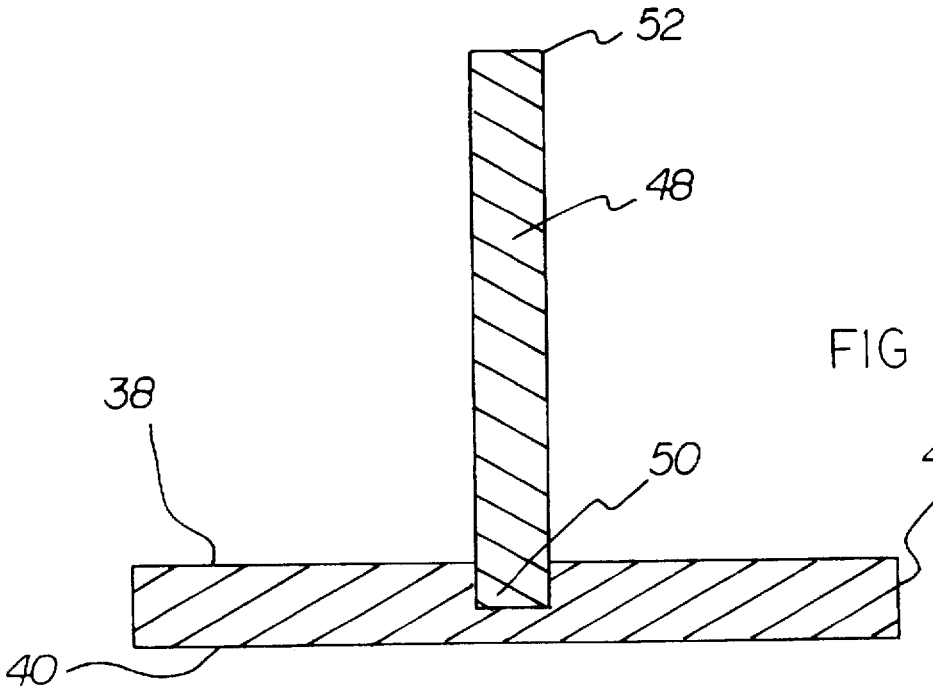
FIG 4

INSULATING SLEEVE REMOVING DEVICE

BACKGROUND OF THE INVENTION

1. Field of the Invention

The present invention relates to an insulating sleeve removing device and more particularly pertains to removing an insulating sleeve from a cylindrical beverage can with an insulating sleeve removing device.

2. Description of the Prior Art

The use of vertical holders is known in the prior art. More specifically, vertical holders heretofore devised and utilized for the purpose of holding toilet paper rolls and the like are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 147,623 to Silvers discloses the ornamental design for a toilet paper holder.

U.S. Pat. No. 4,407,182 to Biasini discloses a musical instrument stand.

U.S. Pat. No. 5,125,609 to Demeo discloses a vertical holder for wall covering rolls.

U.S. Pat. No. 5,280,869 to Ricci discloses a border applying aid.

While these devices fulfill their respective, particular objective and requirements, the aforementioned patents do not describe an insulating sleeve removing device for removing an insulating sleeve from a cylindrical beverage can.

In this respect, the insulating sleeve removing device according to the present invention substantially departs from the conventional concepts and designs of the prior art, and in doing so provides an apparatus primarily developed for the purpose of removing an insulating sleeve from a cylindrical beverage can.

Therefore, it can be appreciated that there exists a continuing need for a new and improved insulating sleeve removing device which can be used for removing an insulating sleeve from a cylindrical beverage can. In this regard, the present invention substantially fulfills this need.

SUMMARY OF THE INVENTION

In the view of the foregoing disadvantages inherent in the known types of vertical holders now present in the prior art, the present invention provides an improved insulating sleeve removing device. As such, the general purpose of the present invention, which will be described subsequently in greater detail, is to provide a new and improved insulating sleeve removing device and method which has all the advantages of the prior art and none of the disadvantages.

To attain this, the present invention essentially comprises an aluminum can having an upper end, a lower end and a cylindrical side wall therebetween. The upper end has a drinking aperture formed therethrough. The aluminum can is adapted to hold a liquid beverage therein. The device includes a cylindrical insulating sleeve having an open upper end, a closed lower end and a cylindrical side wall therebetween. The open upper end is dimensioned to receive the aluminum can therein. The closed lower end has a venting aperture therethrough. The venting aperture is of a reduced diameter as compared to the open upper end of the insulating sleeve. The device includes a base member having an octagonal configuration. The base member has a planar upper surface and a planar lower surface. A side wall of the base member has indicia thereon. The device includes a shaft member having a cylindrical configuration. The shaft member has a lower end secured to a central portion of the planar upper surface of the base member in an orthogonal relationship. The shaft member has a diameter equal to the diameter of the venting aperture of the cylindrical insulating sleeve. The upper end of the shaft member is receivable within the venting aperture for dislodging the aluminum can from within the cylindrical insulating sleeve when positioned therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one, embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved insulating sleeve removing device which has all the advantages of the prior art vertical holders and none of the disadvantages.

It is another object of the present invention to provide a new and improved insulating sleeve removing device which may be easily and efficiently manufactured and marketed.

It is a further object of the present invention to provide a new and improved insulating sleeve removing device which is of durable and reliable construction.

An even further object of the present invention is to provide a new and improved insulating sleeve removing device which is susceptible of a low cost of manufacture with regard to both materials and labor, and which accordingly is then susceptible of low prices of sale to the consuming public, thereby making such an insulating sleeve removing device economically available to the buying public.

Even still another object of the present invention is to provide a new and improved insulating sleeve removing device for removing an insulating sleeve from a cylindrical beverage can.

Lastly, it is an object of the present invention to provide a new and improved insulating sleeve removing device including a base member having a planar upper surface and a planar lower surface. A side wall of the base member has indicia thereon. A shaft member having a cylindrical configuration is secured to a central portion of the planar upper surface of the base member in an orthogonal relationship. An upper end of the shaft member is receivable within a venting aperture of an insulating sleeve for dislodging a can from within the insulating sleeve when positioned therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the preferred embodiment of the present invention.

FIG. 4 is a cross-sectional view as taken along line 4—4 of FIG. 3.

The same reference numerals refer to the same parts through the various Figures.

DESCRIPTION OF THE PREFERRED EMBODIMENT

Figure 1:
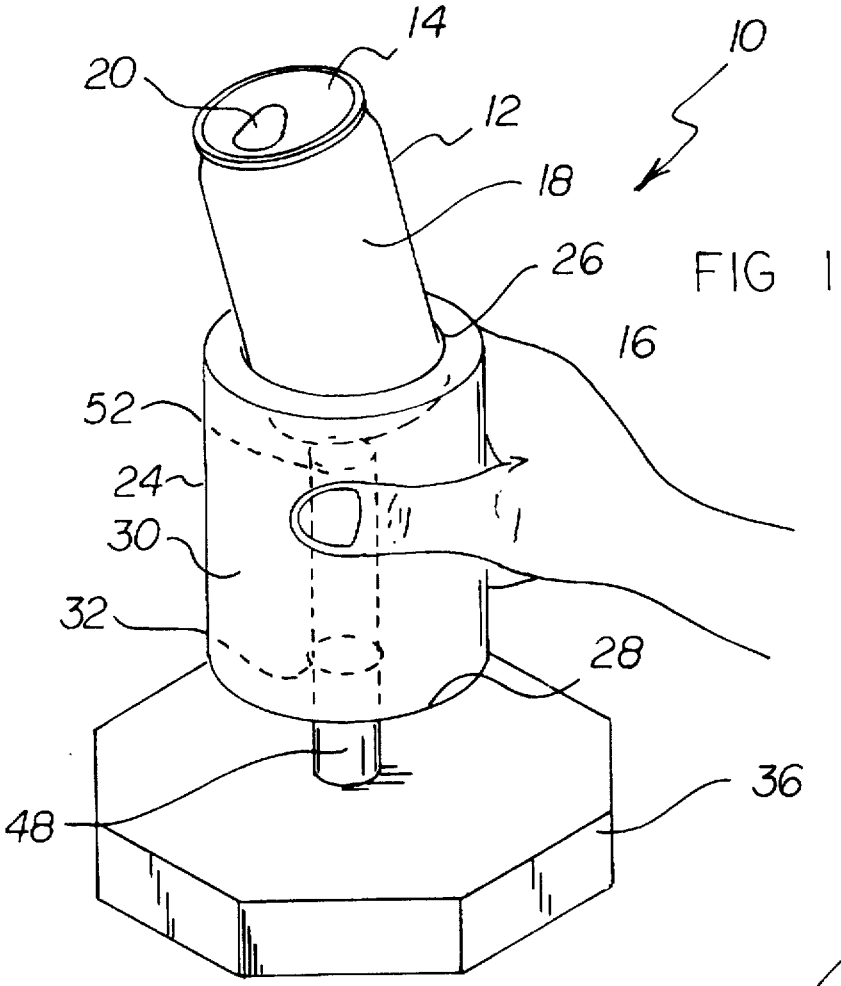
FIG. 1 is a side view of the present invention illustrated in use.
Figure 2:
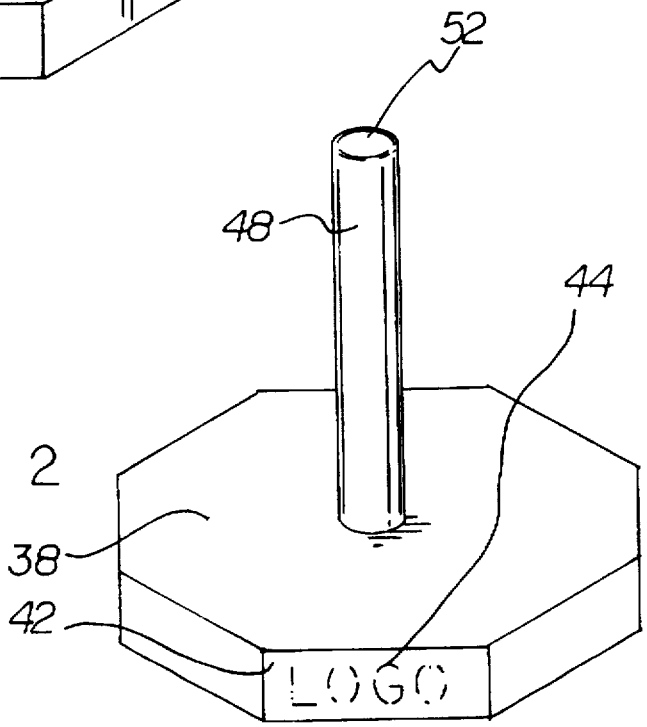
FIG. 2 is an isolated view of the preferred embodiment of the insulating sleeve removing device constructed in accordance with the principles of the present invention.

With reference now to the drawings, and in particular, to FIGS. 1–4 thereof, the preferred embodiment of the new and improved insulating sleeve removing device embodying the principles and concepts of the present invention and generally designated by the reference number 10 will be described.

Specifically, it will be noted in the various Figures that the device relates to an insulating sleeve removing device for removing an insulating sleeve from a cylindrical beverage can. In its broadest context, the device consists of an aluminum can, an insulating sleeve, a base member and a shaft member. Such components are individually configured and correlated with respect to each other so as to attain the desired objective.

The device 10 includes an aluminum can 12 having an upper end 14, a lower end 16 and a cylindrical side wall 18 therebetween. The upper end 14 has a drinking aperture 20 formed therethrough. The aluminum can 12 is adapted to hold a liquid beverage therein. The aluminum can 12 is of a standard configuration known in the art. The preferred size of the aluminum can 12 is one that holds twelve ounces of a liquid beverage.

Associated with the aluminum can 12, the device 10 includes a cylindrical insulating sleeve 24 having an open upper end 26, a closed lower end 28 and a cylindrical side wall 30 therebetween. The open upper end 26 is dimensioned to receive the aluminum can 12 therein. The closed lower end 28 has a venting aperture 32 therethrough. The venting aperture 32 is of a reduced diameter as compared to the open upper end 26 of the insulating sleeve 24. FIG. 1 illustrates the insulating sleeve 24 receiving the aluminum can 12 therein.

Next, the device 10 includes a base member 36 having an octagonal configuration. The base member 36 has a planar upper surface 38 and a planar lower surface 40. A side wall 42 of the base member 36 has indicia 44 thereon. The indicia 44 will serve to label the device in a manner as desired for commercial marketing. Note FIG. 2.

Lastly, the device 10 includes a shaft member 48 having a cylindrical configuration. The shaft member 48 has a lower end 50 secured to a central portion of the planar upper surface 38 of the base member 36 in an orthogonal relationship. Note FIGS. 3 and 4. The shaft member 48 has a diameter equal to the diameter of the venting aperture 32 of the cylindrical insulating sleeve 24. An upper end 52 of the shaft member 48 is receivable within the venting aperture 32 for dislodging the aluminum can 12 from within the cylindrical insulating sleeve 24 when positioned therein.

The device 10 is preferably fabricated from wood (the base member 36 and the shaft member 48 or a like material. The preferable construction of the device 10 would include a height of three inches, 5¾ inches in length and 5¾ inches in width.

In use, a user would place the base member 36 on a flat recipient surface such as a kitchen countertop. Next, the user would grasp the aluminum can 12 with the attached insulating sleeve 24 and hold it over the base member 36. Finally, the user would place the shaft member 48 of the device 10 through the bottom venting aperture 32 of the insulating sleeve 24 and pull the insulating sleeve 24 downwardly. This action will press the shaft member 48 against the lower end 16 of the aluminum can 12 and press it upwardly, thus removing the insulating sleeve 24 from the can 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An insulating sleeve removing device for removing an insulating sleeve from a cylindrical beverage can comprising, in combination:

an aluminum can having an upper end, a lower end and a cylindrical side wall therebetween, the upper end having a drinking aperture formed therethrough, the aluminum can adapted to hold a liquid beverage therein;

a cylindrical insulating sleeve having an open upper end, a closed lower end and a cylindrical side wall therebetween, the open upper end dimensioned to receive the aluminum can therein, the closed lower end having a venting aperture therethrough, the venting aperture being of a reduced diameter as compared to the open upper end of the insulating sleeve;

a base member with a width of about 5 and ¾ inches and a length of about 5 and ¾ inches having an octagonal configuration, the base member having a planar upper surface and a planar lower surface, a side wall of the base member having indicia thereon; and a shaft member having a cylindrical configuration, the shaft member having a lower end secured to a center of the planar upper surface of the base member in an orthogonal relationship, the shaft member having a diameter equal to the diameter of the venting aperture of the cylindrical insulating sleeve, the shaft member having a length equal to a height of the aluminum can, an upper end of the shaft member being receivable within the venting aperture for dislodging the aluminum can from within the cylindrical insulating sleeve when positioned therein;

wherein the insulating sleeve removing device is constructed from wood;

whereby the a user may place the base member on a flat recipient surface and grasp the aluminum can with the sleeve attached thereto and place the shaft member of the device through the bottom venting aperture of the insulating sleeve and pull the insulating sleeve downwardly thereby pressing the shaft member against the lower end of the aluminum can thus removing the insulating sleeve from the aluminum can.

2. A method for removing an insulating sleeve from a cylindrical beverage can comprising the steps of:

providing an aluminum can having an upper end, a lower end and a cylindrical side wall therebetween, the upper end having a drinking aperture formed therethrough, the aluminum can adapted to hold a liquid beverage therein;

providing a cylindrical insulating sleeve having an open upper end, a closed lower end and a cylindrical side wall therebetween, the open upper end dimensioned to receive the aluminum can therein, the closed lower end having a venting aperture therethrough, the venting aperture being of a reduced diameter as compared to the open upper end of the insulating sleeve;

providing a base member with a width of about 5 and ¾ inches and a length of about 5 and ¾ inches having an octagonal configuration, the base member having a planar upper surface and a planar lower surface, a side wall of the base member having indicia thereon; and providing a shaft member having a cylindrical configuration, the shaft member having a lower end secured to a center of the planar upper surface of the base member in an orthogonal relationship, the shaft member having a diameter equal to the diameter of the venting aperture of the cylindrical insulating sleeve, the shaft member having a length equal to a height of the aluminum can, an upper end of the shaft member being receivable within the venting aperture for dislodging the aluminum can from within the cylindrical insulating sleeve when positioned therein, wherein the insulating sleeve removing device is constructed from wood;

placing the base member on a flat recipient surface;

grasping the aluminum can with the sleeve attached thereto;

placing the shaft member of the device through the bottom venting aperture of the insulating sleeve; and pulling the insulating sleeve downwardly thereby pressing the shaft member against the lower end of the aluminum can thus removing the insulating sleeve from the aluminum can.

* * * * *